United States Patent [19]

Toland et al.

[11] 4,022,328

[45] May 10, 1977

[54] FOLDING DISPLAY RACK

[75] Inventors: William D. Toland, Sherwood; Bernard C. Westgate, Jr., Hot Springs; Kenneth N. Burks, Jr., Little Rock, all of Ark.

[73] Assignee: Bradbar Mfg. Corporation, North Little Rock, Ark.

[22] Filed: Apr. 29, 1976

[21] Appl. No.: 681,466

[52] U.S. Cl. ..... 211/149; 108/32

[51] Int. Cl.[2] ..... A47B 43/00

[58] Field of Search ..... 211/149, 150, 195, 104, 211/90, 1.3; 108/111, 32

[56] References Cited

UNITED STATES PATENTS

| | | | |
|---|---|---|---|
| 739,085 | 9/1903 | Kamerer | 211/149 X |
| 2,584,489 | 2/1952 | Morrison | 211/149 |
| 3,139,192 | 6/1964 | Maguire | 211/149 X |
| 3,827,376 | 8/1974 | Solomon | 211/149 X |
| 3,981,511 | 9/1976 | Foster | 211/150 X |

*Primary Examiner*—Roy D. Frazier
*Assistant Examiner*—Robert W. Gibson, Jr.
*Attorney, Agent, or Firm*—Johnson, Dienner, Emrich & Wagner

[57] ABSTRACT

A strong, light-weight rack is disclosed which collapses or folds into a compact form for shipping or storage and opens to orient a plurality of vertically spaced planar shelf members at a proper angle and variable spacing to receive and contain carpet swatches and like samples of goods in convenient, overlapping vertical display. Side portions of the rack as well as the top are hinged so as to fold into compact positions as the shelves articulate into the collapsed position. As the shelves are re-oriented into spaced relationship, the sides and top are foldable into positions for engagement with the frame and rigidify the structure.

6 Claims, 9 Drawing Figures

FOLDING DISPLAY RACK

BACKGROUND OF THE INVENTION

A rigid, non-collapsible display rack for carpet swatches is known and widely used in the art. Such racks include rigid metal side frame members tied together by a plurality of channeled vertically spaced cross braces to which the various shelves are affixed. The shelves are glued or otherwise attached along their inside edges to the side panels of the device. The edges of the side panels are riveted to the frame. Also, the upper back edges of the shelves are attached to the back wall of the rack. None of the parts are hinged or allowed to articulate.

Racks of this nature are extremely bulky, usually measuring 6 or more feet in height, 2 or more feet in width and 7 or 8 inches in depth. Since present freight and hauling rates are based on both weight and volume, these rigid racks are quite expensive to ship. Recent increases in freight and hauling rates have in fact made the costs prohibitive in that they may exceed the selling price the manufacturer obtains for his product. Consequently, a reduction in the volume of racks of this kind without sacrifice of strength, appearance or utility is desirable.

However, these display racks must be fabricated of strong, light-weight and inexpensive materials which do not leave many degrees of freedom when it comes to reducing their volumes for shipping to the end user in knock-down form because of their relative complex structure and the necessity that, in assembled condition, they remain rigid and strong enough to support forty or more carpet swatches of considerable weight.

SUMMARY OF THE INVENTION

It is the primary purpose of this invention to provide a collapsible display rack of this nature that is readily fabricated, easily folded for shipping or storage and, when unfolded for use, retains the strength, lightness of weight and utility of the rigid embodiment. To accomplish this, using the same materials of construction as are present in the rigid form of rack, the various shelves are hinged to the back wall of the rack and also pivoted to the front frame at their reinforcement flanges so that they collapse into staggered contiguous relationship and can be opened to one or more spaced parallel positions whereby to receive the carpet swatches. The front panel and a pair of elongated side flanges which extend from the end edges of the front panel make up a frame to carry the articulated shelves, that are also hinged at their back hidden edges to the back panel of the rack. The reinforcement flanges at the front edges of the shelves receive the bottom edges of the swatches and thus retain them for staggered display. Both the top dust cover and the side panels or portions thereof are hinged so as to engage, respectively, the rear flange in back of the front panel and the elongated channel openings of the side flanges of the frame, to retain the assembly in its unfolded position. The channel openings of the side flanges of the frame have an inner lip therealong and one or more clips are provided on the front edges of the hinged portions of the side panels to engage under these lips and rigidify the assembly in its unfolded condition.

These and other improvements in the construction of the display rack of this invention will be obvious or be described as the specification proceeds.

DESCRIPTION OF THE DRAWINGS

Illustrative embodiments of this invention are shown in the drawings wherein.

DESCRIPTION OF THE PREFERRED EMBODIMENTS

Figure 1:
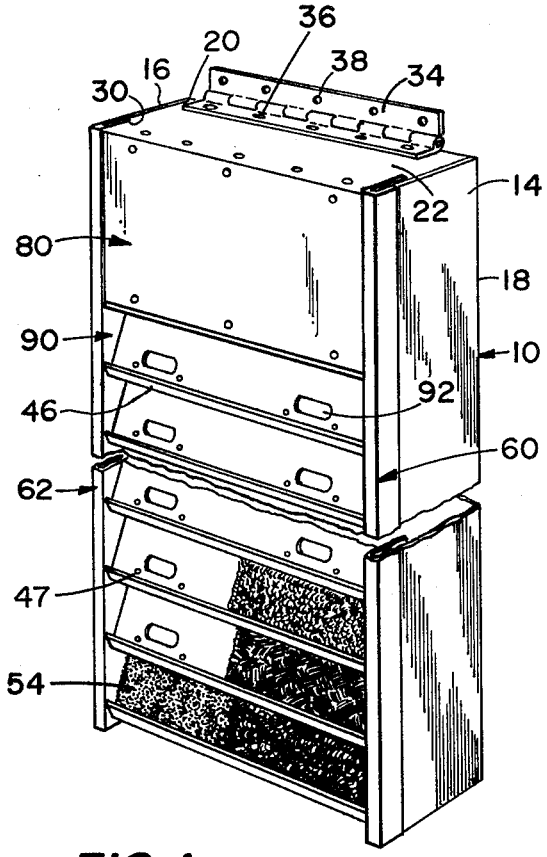
FIG. 1 is a partially fragmentary perspective view of a display rack of this invention shown in unfolded condition with carpet swatches on selected shelves thereof.
Figure 2:
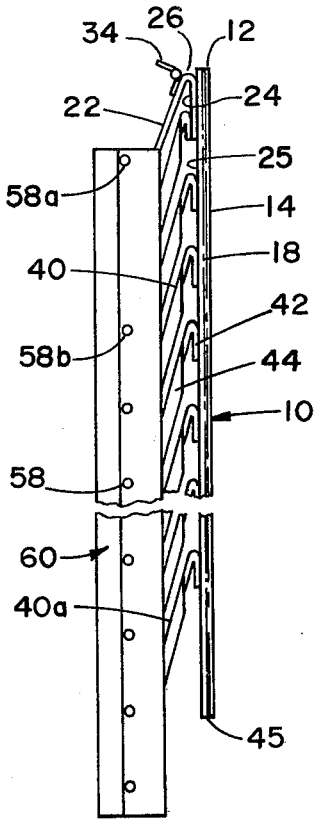
FIG. 2 is a side plan view showing the display rack in its folded position as it would appear when taken out of its shipping carton or ready for storage.
Figure 3:
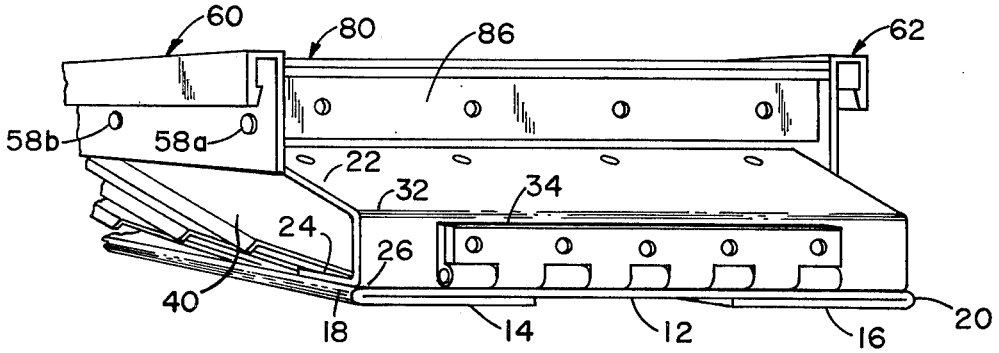
FIG. 3 is a fragmentary perspective view of the top portion of the panel in the folded condition of FIG. 2.

Referring to the drawings, particularly to FIGS. 1, 2 and 3, the display panel 10 of this invention is shown to include the back panel 12 of planar rectangular configuration having hinged thereto the pair of side panels 14 and 16 (see FIGS. 3 and 4) hinged thereto along the hinge lines 18 and 20. A dust cover or top portion 22 is provided at the top of the panel having a flap portion 24 glued or otherwise affixed to the top inside surface 25 of the back panel 12. The dust cover 22 is of lesser width than the back panel 12 as defined by the side edge 28 by an amount equal to twice the thickness of the side panels 14 and 16 so as to close the juncture 30 in the assembled condition of FIG. 1. If desired, the dust cover 22 can have a second hinge line 32 across its top portion running parallel and spaced from the hinge line 26 so as to facilitate folding downward to the closed position as will be described.

A piano-type hinge 34, slightly less in width than the dust cover 22 is affixed thereto as by the series of spaced rivets 36. The holes 38 in the free half of the hinge 34 are for the purpose of attachment to a wall or partition of a room or other structure, if desired, to hold the display panel thereagainst. By these means, a pair of panels can also be fastened back-to-back through their hinges.

Figure 4:
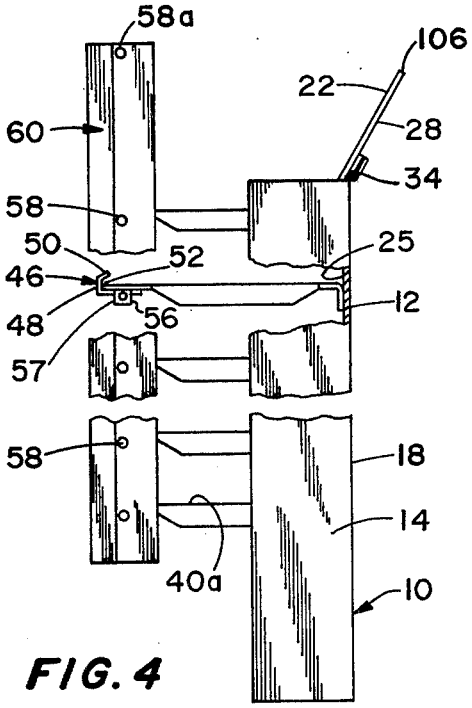
FIG. 4 is a fragmentary side plan view of the display panel in a secondary extended position with the side panels pivoted into their respective side positions ready to be engaged by the side channels of the frame.

Referring to FIG. 4, the back panel 12 carries a plurality of planar shelves 40 of substantially identical construction and dimensions to include the flap portions 42 of each which are glued or otherwise affixed to the inside surface 25 in transverse parallel equally spaced relationship. Each shelf 40 may include an integral folded-down side reinforcing rib 44 on each of its side edges. This array of shelves 40 extends from just under the dust cover 22 at the top to the bottom-most shelf **40*a* which is spaced above the bottom edge 45 of the back panel 12**.

Each of the shelves 40 has an L- or J-shaped channel member 46, see particularly FIG. 4, affixed thereto by a series of spaced rivets 47, FIG. 1, or otherwise attached. The channel member has an upstanding wall 48 and a rearward flange 50 defining an elongated channel opening 52 therealong which receives the edge of a carpet swatch 54, as illustrated in the lower part of FIG. 1. The rearward flange 50 can be normal to the wall 48 of the various channel members 46, or, as illustrated, depend upwardly slightly from the plane of the shelf so that carpets of different thickness are readily accommodated and there is no difficulty in retaining a carpet swatch on the shelves. The channels can be made of any desired material and preferably are constructed of extruded aluminum or an aluminum alloy so as to impart rigidity to the shelves without adding significantly to the weight of the assembly.

Immediately behind the channels 46 on each of the shelves 40 and on each forward side edge there is provided an L or preferably J-shape bracket 56 having a bore hole in a 90° tab 57 to receive a rivet 58 which extends through a corresponding hole in each of the pair of spaced elongated side channels 60 and 62. The rivets 58 and the L- or preferably J-shaped brackets 56, thru a bore hole in the 90° tab 57, hingeably attach the front edges of each shelf to the side channels 60 and 62.

Each of the identical, but reversed, side channels or frame members 60 and 62 has the same cross-sectional configuration to include a flat outer base portion 64, an upstanding wall 66 and a reverse wall or flange 68 having the inner flange 70 therealong which defines the cam surface 72 and the retaining edge 74 all arranged about the channel opening or slot 76 which extends the length of these side channels.

Figure 9:
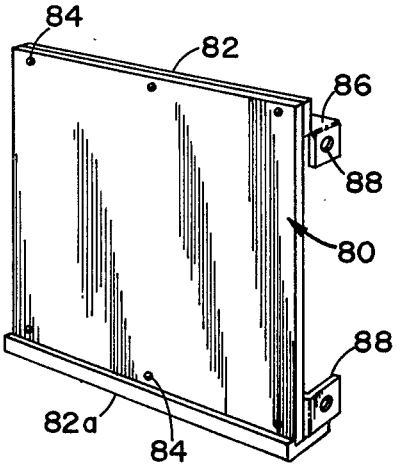
FIG. 9 is a fragmentary perspective view of the front panel of the display rack to show its attaching means.

The side channels are affixed to and vertically spaced by the top trim panel 80 which is about as wide as the individual shelves 40. The mode of attachment therebetween is illustrated in FIG. 9 wherein the panel 80 is shown to include the top L-shaped angle member 82 along its top edge and held by means of the rivets 84 along one leg thereof. The other leg 86 forms a flange or support surface for the dust cover 22 (as will be described) and has a pair of cleats 88, one at each end (only one shown) which depend downwardly in a position to be received by the topmost of the rivets **58*a* that extend through the respective side channels 60 and 62**.

Along the bottom edge of the front panel 80, a similar L-shaped angle member **82*a* is provided with one leg under this bottom edge and the other leg extending upwardly behind and adjacent to the back side of the front panel 80 for receiving the attaching rivets 84. An extension or tab 88 is also provided at each end of the other leg to receive the next adjacent rivets 58*b* (on each side) as shown in FIG. 2** to complete the attachment.

The front panel 80 and the two spaced vertical channels 60 and 62 define a frame with a display opening 90 (FIG. 1) wherein the carpet swatches 54 are displayed. As further shown in FIG. 1, each shelf 40 has one or more rounded openings 92 just above the front hinges. These are for the purpose of inserting one's fingers from underneath so that the carpet swatches can be pushed out and more readily removed.

Figure 8:
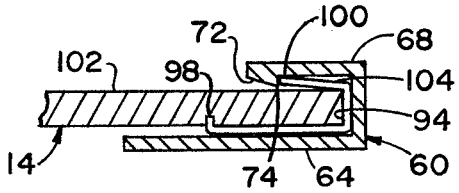
FIG. 8 is a fragmentary cross-sectional view taken along lines 8—8 of FIG. 6.
Figure 5:
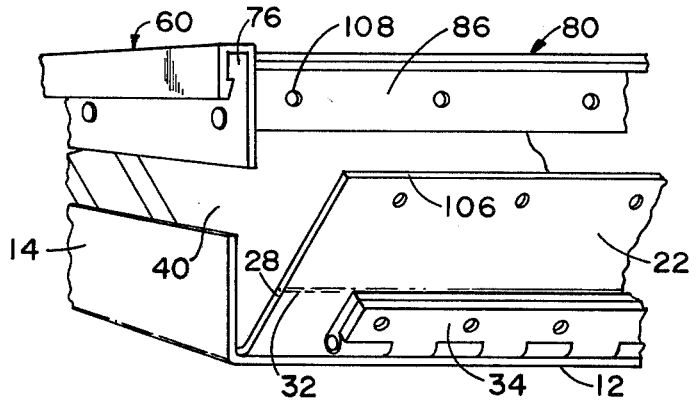
FIG. 5 is a fragmentary perspective view of the display panel in a position similar to that of FIG. 4 and with the panel parts partially foled to a set up position.
Figure 6:
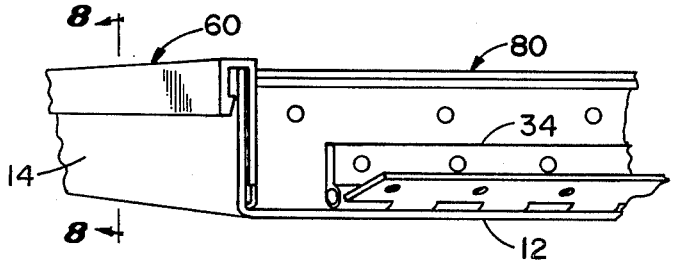
FIG. 6 is a fragmentary perspective view of the panel as shown in FIG. 5 but with the folding parts in assembled condition.
Figure 7:
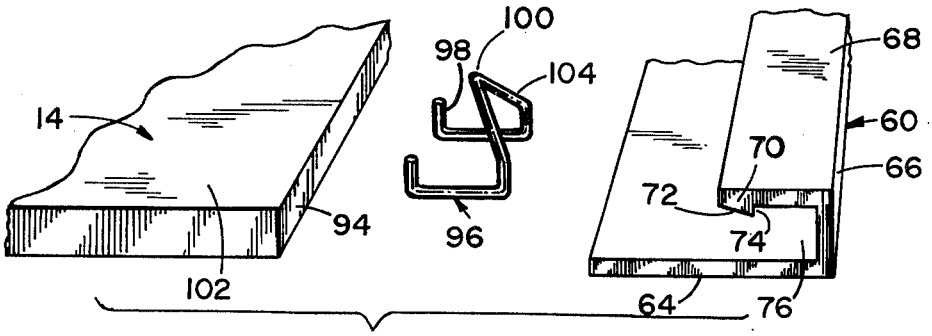
FIG. 7 is a fragmentary exploded perspective view of a side channel, the side wall and the interlocking clip therefor.

As shown in FIGS. 5 and 6 and also in FIGS. 7 and 8, the front edges 94 of each hinged side wall 14 are adapted to slide between the opening or slot 76 of the side channels 60 and 62 in the assembled condition of the display panel 10. In order to retain the side panels 14 and 16 in this relationship a resilient protuberant means is provided in the form of the wire U-shaped clip member 96 having the bent-up tabs 98 which are embedded in the side wall 14 with the bight portion thereof formed into a spring-point 100 that is bent back and extends above the outer surface 102 of the side wall 14 or 16. As shown in FIG. 8, when the side walls are so positioned the spring point 100 engages behind the edge 74 in the side channel openings 76 and is locked in place. To remove the side walls 14 and 16 it is only necessary to engage the points 100 on the bight portions 104 with the tip end of a flat instrument such as a screw driver.

Referring back to FIGS. 2 and 3 it is seen that in the folded condition of the display panel 10, the side walls 14 and 16 are hinged back flat against the back side of the back wall 12, and the dust cover 22 is hinged downwardly against the topmost of the shelves. By pulling the back panel 12 away from the front panel 80, these parts are now free to pivot along their hinge lines to the positions shown in FIGS. 4 and 5 where the dust cover 22 is raised above the flange 86 and the side walls 14 and 16 are pivoted 270° to positions in the plane of the channels 60 and 62. At the same time the shelves are pivoted to relatively horizontal positions, Next, when the back and front panels are pushed toward each other the edges 94 of the side walls 14 and 16 engage in the channels 76 as shown in FIGS. 6 and 8 and the dust cover is then lowered so that its outer edge 106 comes to rest on the flange 86 behind the top edge of the front panel 80. Temporary or permanent fasteners or rivets can be used to affix the dust cover to the flange 86 as at the holes 108. The panel then assumes the ready condition shown in FIG. 1 for receipt of the carpet swatches 54.

The back panel 12, the side walls 14 and 16 as well as the front panel 80 and the various shelves are preferrably fabricated from light weight strong material such as cardboard, pressed paper, pressed wood, fiber board, plywood, plastic or the like which retains its dimensional characteristics and can include a decorative finish surface if and where desired. The display rack can be used for the display of any kind of merchandise such as carpet, linoleum wall covering panels and related products which require an angular planar space for displaying and are readily removed for closer inspection. The extruded aluminum parts including the flanges can be formed of other materials including plastic, cold rolled steel or various laminated structures.

It must be realized that very expensive machinery is required to assemble the parts of a rigidified structure suitable for the same purposes as the instant rack. This is because the parts become more and more inaccessable as assembly progresses. In contrast, this invention eliminates the need for expensive and complicated assembly machinery.

The lateral width of the side walls 14 and 16 as well as the dust cap 22 can be fabricated in variable coordinated dimensions at the point of manufacture which predetermines the angle of the shelf and the width of the sides in the final assembled condition, as specified by the need of the end user.

What is claimed is:

1. A display rack comprising:

an elongated back panel having a pair of coextensive side panels hinged thereto along its side edges;

a pair of elongated frame members of substantially the same length as said back panel;

a front panel member having substantially the same width as said back panel affixed at its side edges to and between the top ends of said frame members and defining thereunder a front display opening;

said frame members each having an outer rearwardly open channel along their lengths; and a plurality of shelf members hingeably attached and substantially equally, vertically spaced along their back edges to said back panel and having their front corners pivoted with substantially the same vertical spacing between said frame members across said display opening whereby said back panel and said front panel are adapted to articulate along said hinges and pivots from a folded essentially flat position with said shelf members in substantially contiguous relationship to an opened errected position with the edges of said side panels engaged within and retained by said open channels of said frame members.

2. A display rack in accordance with claim 1 in which:

front panel includes a flange portion extending along and under its top edge; and said back panel includes a dust cover hingeably attached along its top edge whereby in the folded flat position of said rack, said dust cover folds into adjacency with the topmost of said shelf members and in the erected position said dust cover is engageable upon said flange along the top edge of said front panel for attachment thereto.

3. A display rack in accordance with claim 1 in which:

said rearwardly facing channel openings have an inner closing flange therealong; and said side panels each include at least one edge protuberance intermediate their ends adapted to engage behind said inner flange to resiliently and removably retain said side panels therein.

4. A display panel in accordance with claim 3 wherein:

said edge protuberance comprises a spring clip member affixed to said side panels having an arcuate bight portion extending rearwardly over the edge of said side panels.

5. A display rack in accordance with claim 1 in which:

said shelf members include at least one hand hole along their front edges so that material displayed therein can be raised from underneath for removal.

6. A display rack in accordance with claim 1 in which:

said dust cover and side walls are adapted to shortened and lengthened to provide panels of selected depth and an array of shelves at selected display angles from the vertical.

* * * * *